US005692529A

United States Patent [19]

Fekete

[11] Patent Number: 5,692,529

[45] Date of Patent: Dec. 2, 1997

[54] SHAVING RAZOR WITH INTEGRAL MIRROR

[76] Inventor: Janet Fekete, 330 W. Brambleton Ave., Apt. 1904, Norfolk, Va. 23510

[21] Appl. No.: 662,269

[22] Filed: Jun. 12, 1996

Related U.S. Application Data

[63] Continuation of Ser. No. 423,700, Apr. 18, 1995, abandoned.

[51] Int. Cl.[6] ..... A45D 42/08

[52] U.S. Cl. ..... 132/291; 30/34.05; 30/123; 30/526

[58] Field of Search ..... 132/200, 291, 132/289, 316; D28/44, 45, 48; 30/34.05, 123, 526, 537

[56] References Cited

U.S. PATENT DOCUMENTS

| | | | |
|---|---|---|---|
| D. 250,664 | 12/1978 | Kruger et al. . | |
| D. 352,568 | 11/1994 | Meisner et al. | D28/48 |
| D. 363,142 | 10/1995 | Shurtleff | D28/48 |
| 892,246 | 6/1908 | Gamber | 132/316 |
| 1,388,955 | 8/1921 | Kozlowsky et al. . | |
| 1,506,401 | 8/1924 | Young . | |
| 1,676,183 | 7/1928 | Garfunkle . | |
| 2,037,588 | 4/1936 | Pica . | |
| 2,341,743 | 2/1944 | Rothner . | |
| 2,799,927 | 7/1957 | Beham | 30/526 |
| 4,094,062 | 6/1978 | Papanikolaou . | |

FOREIGN PATENT DOCUMENTS

| | | | |
|---|---|---|---|
| 2414388 | 9/1979 | France | 30/34.05 |
| 2250942 | 6/1992 | United Kingdom | 30/34.05 |

*Primary Examiner*—Todd E. Manahan
*Attorney, Agent, or Firm*—Frishauf, Holtz, Goodman, Langer & Chick

[57] ABSTRACT

Enhanced visibility of a region being shaved is provided by a mirror disposed on an inner (front) surface of a handle portion of a shaving razor. The mirror is integrally mounted to the handle portion, and may be mounted to the surface of the handle portion, or recessed within the surface of the handle portion to be flush therewith. The mirror may be planar, convex or concave. The handle portion may be textured. Various front and side profiles for the handle portion may be provided. In use, a light may be directed at the region being shaved via the mirror.

14 Claims, 4 Drawing Sheets

SHAVING RAZOR WITH INTEGRAL MIRROR

This application is a Continuation of application Ser. No. 08/423,700, filed Apr. 18, 1995 now abandoned.

TECHNICAL FIELD OF THE INVENTION

The invention relates to the construction of razors, and their usage in removing hair from a surface of a user's body.

BACKGROUND OF THE INVENTION

It is generally accepted that a user ought to observe what he or she is doing, while shaving. This "maxim" would apply whether the user is shaving their face, their legs, or any other surface on their body. This, of course, generally requires that the user perform the shaving operation in a well-illuminated area, and typically requires the instrumentality of a separate and distinct mirror with which to observe the area being shaved.

For example, when a user is shaving their face, the shaving operation is typically performed in front of a bathroom-type mirror (e.g., a mirror mounted to a wall over a sink, or wash basin), whereupon the user is able to view the surface (e.g., portion of their face) being shaved during the shaving operation. The mirror, being at eye level, presents the user with a normal (i.e., 90°), head-on view of the shaving operation, and the user will often lean over the sink to obtain a closer view of the surface being shaved.

The use of a bathroom mirror is generally inapplicable when the user is shaving their legs. This shaving operation is typically performed by the user propping their foot upon a suitable pedestal (such as a commode, rim of a bathtub, or the like). Generally, such a shaving operation is performed away from the bathroom mirror and, inasmuch as bathroom mirrors are mounted at eye level, rather than at leg level, they would not be a convenient means of assisting the user to view the leg surface being shaved.

The problems associated with shaving legs is exacerbated by the fact that the user is typically, at best, presented with a "glancing" (non-normal) view of the surface being shaved. The use of external viewing means, such as a portable mirror positioned near the surface being shaved, would be cumbersome and would require the user to constantly reposition themselves and/or the mirror in order to obtain a clear view of the surface being shaved.

What is needed is an instrumentality that provides the user with a clear, non-glancing view of the shaving operation, especially when the user is using a razor to shave their legs.

U.S. Pat. No. 2,037,588 discloses a safety razor having removably secured to the handle a shaving mirror including a series of mirror strips (39) which may easily be folded about the handle when not in use, and which may readily be unfolded to provide a reflecting surface when in use. The mirror strips may be securely hinged together by a flexible cloth backing, or the like. When not in use, the mirror may be folded around the handle (5) of the safety razor and held in position by an elastic band or other fastening means. It would appear that the user must remove the mirror from the handle, unfold it, and hold it in one hand while shaving with the other hand in order to obtain some utility from the mirror.

U.S. Pat. No. 2,341,743 discloses a shaving device having a magnifying lens positioned relatively near the shaving portion of the device to provide the user with an enlarged view of the portion of the face being shaved. In use, an image of the portion of the face being shaved is magnified (passes through the magnifying lens portion of the shaving device), and the magnified image may be viewed by the user observing the magnified image in a conventional (e.g., bathroom), separate mirror.

U.S. Pat. No. 4,094,062 discloses an illuminated razor provided with directive means for illuminating an area previously shaved. A light bulb is incorporated into the razor, the head of which is formed of a light conductive and partially reflective acrylic plastic of translucent material for directing the output of the light bulb.

U.S. Pat. No. 1,676,183 discloses an attachment for razors which may be reflecting or illuminating. The attachment comprises a detachable frame adapted to support a mirror or reflecting surface preferably pivotally mounted whereby light is reflected upon the surface being shaved, and also supporting thereabove an electric light for the purpose of intensifying the light reflection from the mirror upon the surface being shaved. The frame (1) extends above (away from the handle) the head of the razor, and the light bulb (13) is mounted to a distal portion thereof. Such an arrangement would evidently interfere with positioning the head of the razor on the surface being shaved (e.g., shaving hard to get to places).

U.S. Pat. No. 1,506,401 discloses a toothbrush having a mirror (c) provided at an end of the handle (a) which is opposite the bristles (b) of the toothbrush. Generally, the mirror is not operative in use (i.e., while brushing teeth), but rather is used to inspect the teeth, and requires the use of an additional, external mirror, such as a bathroom mirror. It would appear that the mirror would be obscured by the user's hand while employing the toothbrush to brush their teeth.

U.S. Pat. No. 1,388,955 discloses a combined brush and comb having a mirror (11') mounted in the handle (11) thereof. It would appear that the mirror is not usable at the same time that the user is brushing their hair.

U.S. Pat. No. D-250,664 discloses a razor having a broad, generally flat and contoured (e.g., rather than traditionally elongate) handle.

The entire contents of all of the above-described U.S. patents are incorporated herein by reference.

SUMMARY OF THE INVENTION

It is therefore an object of the present invention to provide an improved shaving razor, and technique of employing same.

It is a further object of the present invention to provide viewing device, integral with the razor, for facilitating the user viewing a region (area) of their body being shaved.

It is a further object of the present invention to provide a device for facilitating the user illuminating a region of their body being shaved.

According to the invention, a shaving razor includes a handle having an end, a head with a razor blade at the end of the handle portion, and a mirror integrally mounted to the handle.

According to a feature of the invention, the mirror is mounted to an external surface of the razor handle body.

According to an alternate feature of the invention, the mirror is recessed within the external surface of the razor handle body.

According to another feature of the invention, the razor handle body is textured, to facilitate gripping, by the user.

The handle may have an arcuate side profile and/or generally rectangular front profile.

In an alternate embodiment of the invention, the handle has a generally bottle-shaped front profile.

In use, the user grasps the razor and moves it across a surface of their body. While doing so, the user is above to observe a to-be-shaved region of the surface via a mirror integrally mounted to a handle portion of the razor.

Optionally, the user can also position an external light to illuminate the surface being shaved, via the handle-mounted mirror.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawings. Although the invention will be described in the context of these preferred embodiments, it should be understood that it is not intended to limit the spirit and scope of the invention to these particular embodiments.

DETAILED DESCRIPTION OF THE INVENTION

Figure 1B:
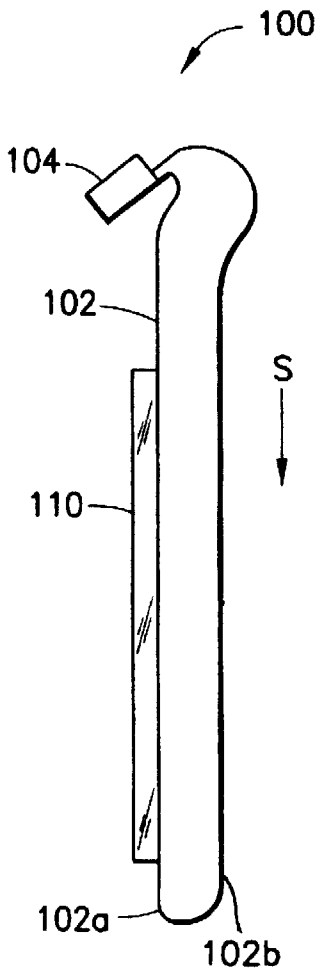
FIG. 1B is a side view of the razor of FIG. 1A, according to the present invention.
Figure 1A:
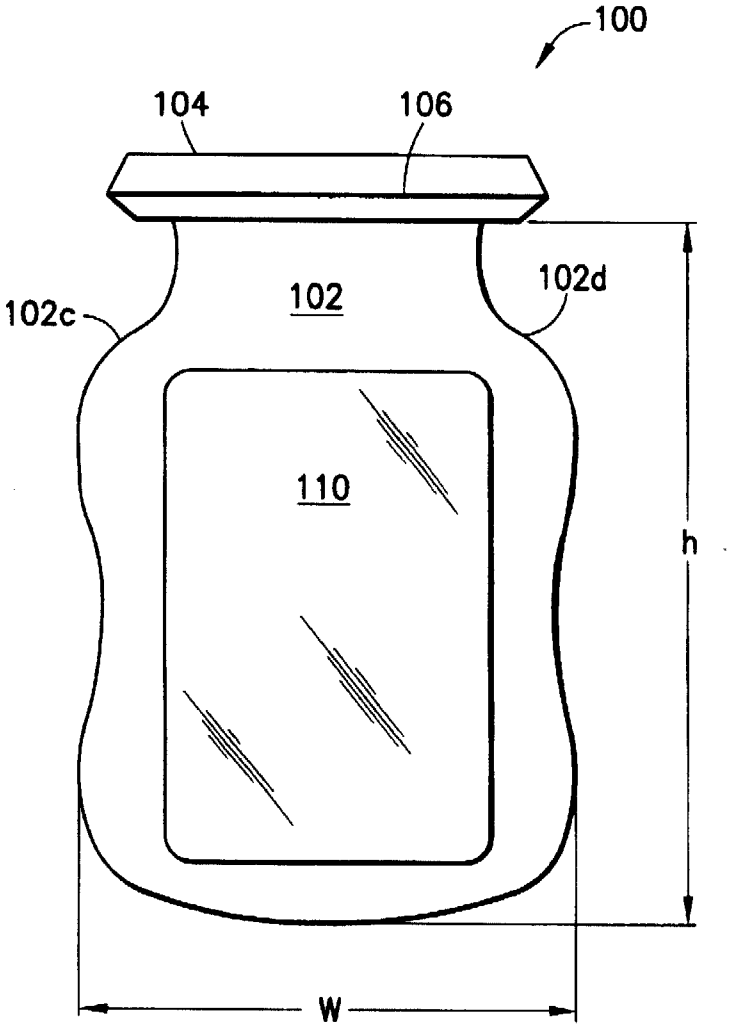
FIG. 1A is a front view of an embodiment of a razor according to the present invention.

FIGS. 1A and 1B illustrate an embodiment of the shaving razor 100 of the present invention. The razor 100 comprises two major components: a handle portion 102 and a head portion 104. The head portion 104 (shown somewhat stylized) carries a razor blade 106. The head portion 104 is disposed at a top (as viewed) end of the handle portion 102. The blade 106 extends in a generally widthwise direction (left-to-right in the view of FIG. 1A).

The handle portion 102 is generally flat and broad, and is generally rectangular (has a generally rectangular front profile), and has an exemplary width "w" in the range, for example, of 2–3 inches, and has an exemplary height "h" in the range of, for example, 3–5 inches. The handle portion 102 has a front surface **102*a*, and a back surface 102*b*. As illustrated in the view of FIG. 1A, the side edges 102*c* and 102*d* of the handle portion 102 are slightly curved (i.e., "wavy"), facilitating the user grasping the handle portion 102 with their hand (with the back surface 102*b* of the handle portion 102 against the user's palm). The handle portion 102 is generally rectilinear (straight) in side profile, as best viewed in FIG. 1B. The top edge of the handle portion 102, where the head portion 104 is mounted to (or formed in conjunction with) the handle portion 102**, is generally rectilinear (i.e., straight).

A mirror 110 is mounted in any suitable manner (such as with an adhesive, not shown) to the front surface **102*a* of the handle portion 102, is generally rectangular, and has an exemplary width in the range of, for example, 1½–2½ inches, and has an exemplary height in the range of, for example, 2½–4½ inches. The mirror 110 is not intended to be detachable from the handle portion, but rather is permanently attached thereto. It is in this sense that the mirror 110 is considered to be an "integral" part of the razor 100**.

In use, the user grasps the handle portion 102 of the razor 100, and moves the razor 100 in a manner that the blade 106 traverses a region of the user's skin (not shown) having hair which is desired to be removed (shaved). This typically involves moving the razor 100 in a direction indicated by the arrow "S" (see FIG. 1B), with the razor inclined relative to the arrow S and relative to the skin surface being shaved. A region of skin that has been shaved is above (as viewed in FIG. 1B) the head portion 104, and a region of skin that is to be shaved is below (as viewed in FIG. 1B) the head portion 104. In this manner, the mirror 110 will be in a position opposing (facing, inclined to, and spaced apart from) the to-be-shaved skin region.

Figure 2B:
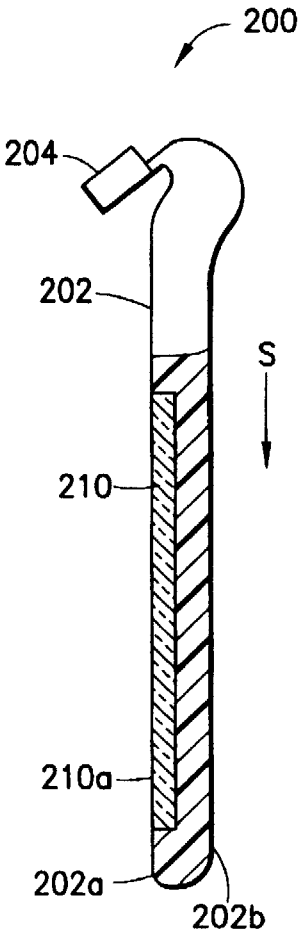
FIG. 2B is a side, cross-sectional view of the razor of FIG. 2A, according to the present invention, taken along line 2B—2B in FIG. 2A.

As will be illustrated in greater detail hereinbelow (i.e., with respect to FIG. 2B), the mirror 110 of FIGS. 1A and 1B can be recessed into the front surface **102*a* of the handle portion 102** in the same manner as shown in FIG. 2B.

As will be illustrated in greater detail hereinbelow (i.e., with respect to FIG. 3B), the handle portion (102) can be provided with a similarly textured surface.

As will be described in greater detail hereinbelow with respect to FIG. 4, the handle-mounted mirror 110 of FIGS. 1A and 1B provides the user with a clear view of the to-be-shaved skin region.

Figure 2A:
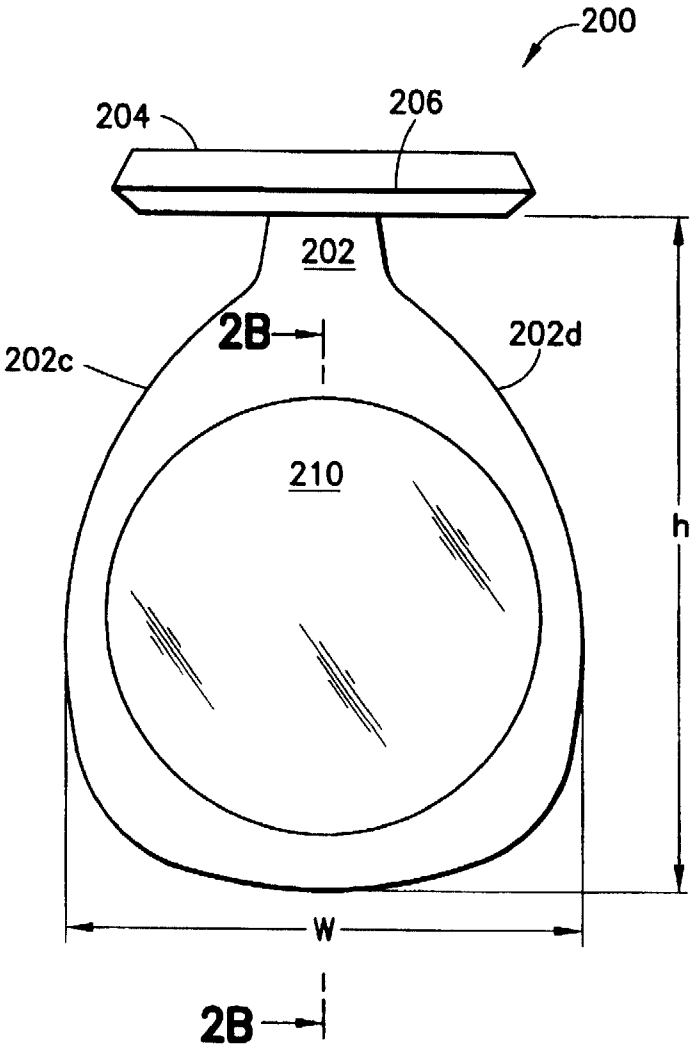
FIG. 2A is a front view of an alternate embodiment of a razor according to the present invention.

FIGS. 2A and 2B illustrate another embodiment of the shaving razor 200 of the present invention. The razor 200 comprises two major components: a handle portion 202 and a head portion 204. The head portion 204 (shown somewhat stylized) carries a razor blade 206. The head portion 204 is disposed at a top (as viewed) end or edge of the handle portion 202. The blade 206 extends in a generally widthwise direction (left-to-right in the view of FIG. 2A).

The handle portion 202 is generally flat and broad, and is generally bottle-shaped (in front profile), and has an exemplary width "w" in the range of, for example, 2–3 inches, and has an exemplary height "h" in the range of, for example, 3–5 inches. The handle portion 202 has a front surface **202*a*, and a back surface 202*b*. As illustrated in the view of FIG. 2A, the side edges 202*c* and 202*d* of the handle portion 202 are greatly curved (i.e., "arcuate"), facilitating the user grasping the handle portion 202 with their hand (with the back surface 202*b* of the handle portion 202 against the user's palm). The handle portion 202 is generally rectilinear in side profile, as best viewed in FIG. 2B. The top edge of the handle portion 202, where the head portion 204 is mounted to (or formed in conjunction with) the handle portion 202**, is generally rectilinear (i.e., straight).

A mirror 210 is mounted in any suitable manner (such as with an adhesive, not shown) recessed within the front surface **202*a* of the handle portion 202**, is generally circular, and has an exemplary diameter in the range of, for example, 1½–2½ inches.

In the embodiment of FIGS. 2A and 2B, the mirror 210 is recessed within the front surface **202*a* of the handle portion 202, by providing the front surface 202 with a recess having a depth corresponding to the thickness (left-to-right, as viewed in FIG. 2B) of the mirror 210. Preferably, the front surface 210*a* of the mirror 210 is flush with the front surface 202*a* of the handle portion 202**.

As in the previous embodiment of FIGS. 1A and 1B, the mirror 210 is not intended to be detachable from the handle portion, but rather is permanently attached thereto. It is in this sense that the mirror 210 is considered to be an "integral" part of the razor 200.

In use, the user grasps the handle portion 202 of the razor 200, and moves the razor 200 in a manner that the blade 206 traverses a region of the user's skin (not shown) having hair which is desired to be removed (shaved). As described hereinabove, this typically involves moving the razor 200 generally in a direction indicated by the arrow "S" (see FIG. 2B), with the razor inclined relative to the arrow S and relative to the skin surface being shaved. A region of skin that has been shaved is above (as viewed in FIG. 2B) the head portion 204, and a region of shin that is to be shaved is below (as viewed in FIG. 2B) the head portion 204. In this manner, the mirror 210 will be in a position opposing (facing, inclined to, and spaced apart from) the to-be-shaved skin region.

As was discussed with respect to the razor 100 of the previous embodiment, the mirror 210 can be mounted attached to the front surface 202*a* of the handle portion 202 rather than recessed therein.

As will be illustrated and described in greater detail hereinbelow (i.e., with respect to FIG. 3B), the handle portion 202 of FIGS. 2A and 2B can be provided with a textured surface.

As will be described in greater detail hereinbelow with respect to FIG. 4, the handle-mounted mirror 210 of FIGS. 2A and 2B provides the user with a clear view of the to-be-shaved skin region.

Figure 3B:
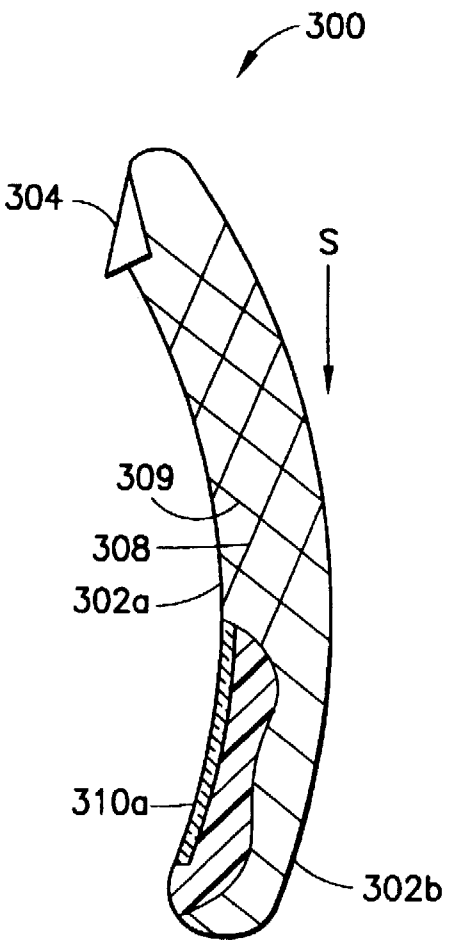
FIG. 3B is a side view, partially broken away, of the razor of FIG. 2A, according to the present invention.
Figure 3A:
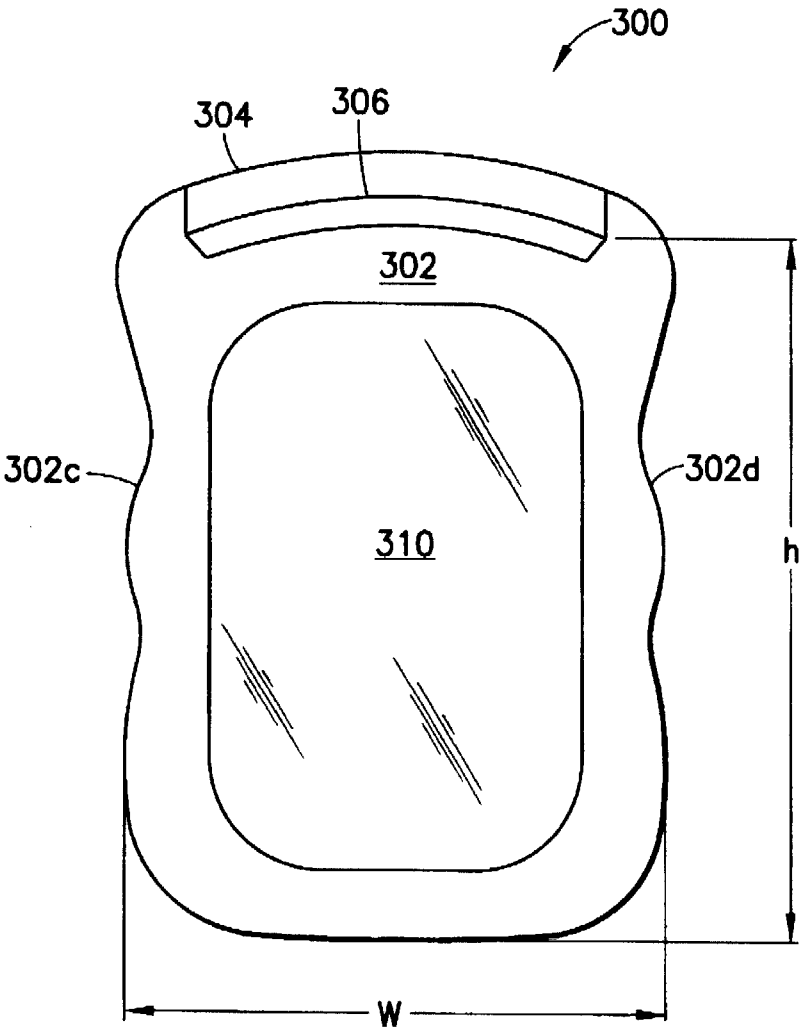
FIG. 3A is a front view of an alternate embodiment of a razor according to the present invention.

FIGS. 3A and 3B illustrate an embodiment of the shaving razor 300 of the present invention. The razor 300 comprises two major components: a handle portion 302 and a head portion 304. The head portion 304 (shown somewhat stylized) carries a razor blade 306. The head portion 304 is disposed at a top (as viewed) end or edge of the handle portion 302. The blade 306 extends in a generally widthwise direction (left-to-right in the view of FIG. 3A).

The handle portion 302 is generally curved (has an arcuate side profile) and broad, and is generally rectangular, and has an exemplary width "w" in the range of, for example, 2–3 inches, and has an exemplary height "h" in the range of, for example, 3–5 inches. (In the frontal view of FIG. 3A the razor 300 bears a close resemblance to the frontal view of the razor 100 of FIG. 1A.) The handle portion 302 has a front surface 302*a*, and a back surface 302*b*. As illustrated in the view of FIG. 3A, the side edges 302*c* and 302*d* of the handle portion 102 are wavy, facilitating the user grasping the handle portion 302 with their hand (with the back surface 302*b* of the handle portion 302 against the user's palm). The top edge of the handle portion 302, where the head portion 304 is mounted to (or formed in conjunction with) the handle portion 302, is generally arcuate.

As best viewed in FIG. 3B, the front surface 302*a* of the handle portion 302 is concave, and the back surface 302*b* of the handle portion 302 is convex.

A curved mirror 310 is mounted in any suitable manner (such as with an adhesive, not shown) within a recess in the front surface 302*a* of the handle portion 302 (compare recessed mirror 210).

The mirror 310 is generally rectangular with rounded corners (as illustrated in the front view of FIG. 3A), and has an exemplary width in the range of, for example, 1½–2½ inches, and has an exemplary height in the range of, for example, 2½–4½ inches. The mirror 310 is not intended to be detachable from the handle portion, but rather is permanently attached thereto. It is in this sense that the mirror 310 is considered to be an "integral" part of the razor 300.

Whereas the mirrors 110, 210 of the previous embodiments were substantially flat mirrors, the mirror 310 of this embodiment is curved (arcuate), generally following the curve of the front surface 302*a* of the handle portion 302. By being concave curved (as shown), rather than planar, the mirror 310 will magnify an image of the to-be-shaved region. (By way of analogy, automobile mirrors are typically convex curved, making images appear smaller (further away) than they would appear in a flat mirror.)

It is within the scope of this invention that the mirror 310 would be curved in the opposite direction, with its front surface 310*a* convex, which would provide a reduced image of the to-be-shaved skin region. It is also within the scope of this invention that a convex mirror could be mounted in a concave handle, or that a concave mirror could be mounted to a convex handle, or that a substantial flat mirror could be mounted to a curved (concave or convex) handle, as may be desired.

In use, the user grasps the handle portion 302 of the razor 300, and moves the razor 300 in a manner that the blade 306 traverses a region of the user's skin (not shown) having hair which is desired to be removed (shaved). This typically involves moving the razor 300 generally in a direction indicated by the arrow "S" (see FIG. 1B), with the razor inclined relative to the arrow S and relative to the skin surface being shaved. A region of skin that has been shaved is above (as viewed in FIG. 3B) the head portion 304, and a region of shin that is to be shaved is below (as viewed in FIG. 3B) the head portion 304. In this manner, the mirror 310 will be in a position opposing (facing, inclined to, and spaced apart from) the to-be-shaved skin region.

In this example of a razor 300, the handle 302 is textured, as illustrated by intersecting sets of grooves 308 and 309, which may he molded into the handle 302. In the context of shaving with a razor or with hands that may be wet, these grooves will assist the user in maintaining a good hold on the handle (302).

As was discussed with respect to the razor 100, the mirror 310 can be mounted to the front surface 302*a* of the handle portion 302 rather than being recessed therein.

As will be described in greater detail hereinbelow with respect to FIG. 4, the handle-mounted mirror 110 provides the user with a clear view of the to-be-shaved skin region.

The handle portions 102, 202, 302 and respective head portions 104, 204, 304 of all of the embodiments described hereinabove are preferably made of molded plastic material. The type of plastic is not critical. The shaving blade portion of the head portions 104, 204, 304 are also conventional and may be of any desired type made by manufacturers such as Gillette, Schick, etc. The shaving blade portion of the shaving head portions may carry permanently mounted shaving blades so that the device is disposable, or replaceable blade mechanisms can be used. Examples of replaceable blades usable in the present invention are the Schick Tracer blades, Gillette Trac II blades, and Gillette Sensor blades.

A light may be incorporated into the shaving handle, for example as disclosed in U.S. Pat. No. 4,094,062. In this case, the handle is preferably formed of a light conductive plastic material such as disclosed in U.S. Pat. No. 4,094,062.

Details of the shaving head portions 104, 204, 304 are not provided herein since such shaving head portions are notoriously well known in the art.

Figure 4:
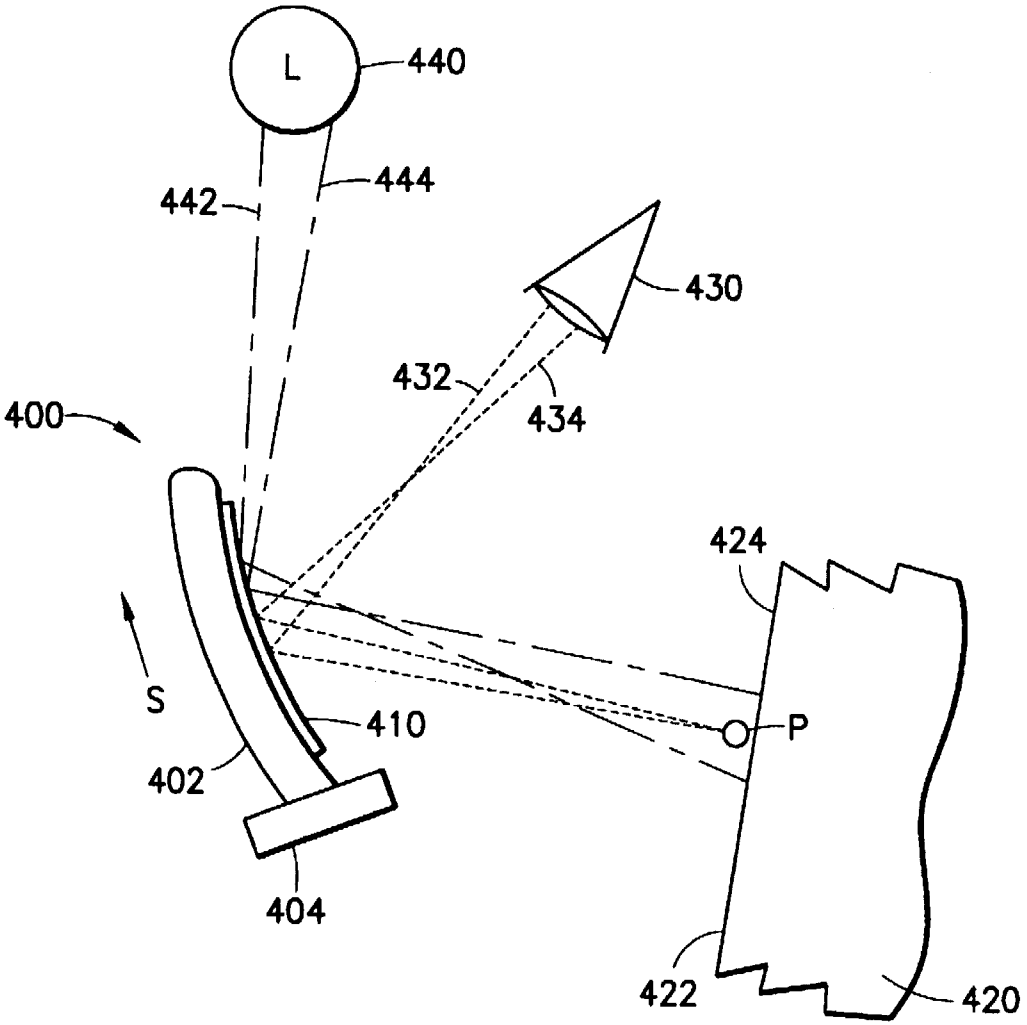
FIG. 4 is a schematic explanatory view of the razor of FIGS. 3A and 3B, in use, according to the present invention.

FIG. 4 illustrates, schematically, use of a razor to remove hair from the skin of the user. In this illustration, a razor 400 is shown having a handle portion 402 curved in the manner of the handle 302 of the razor 300 of FIGS. 3A and 3B, and a head portion 404 (compare 304). An inner surface of the handle portion 402 is provided with a concave mirror 410 (mounted on rather than recessed in the front surface of the handle 402). An example of the razor 400 in use is given as exemplary of the use of any of the aforementioned razors.

The user grasps the handle portion 402, and places the head portion 404 in position against and inclined to (as seen in FIG. 4) a body part 420 intended to be shaved. The body part 420 in FIG. 4 is intended to be a user's lower leg. In the illustration of FIG. 4, an exaggerated space is shown between the razor 400 and the body part 420 for ease of illustration and understanding. Point "P" on a surface of the body part 420 being shaved is shown.

During use, the angle of inclination of the handle portion of the shaver is preferably about 45° relative to the surface of the skin which is being shaved, as shown in FIG. 4. That is, the shaving handle portion is inclined at an angle of about 45° with respect to the moving direction represented by the arrow S in FIG. 4. The same angle of inclination is preferably used for the embodiments of FIGS. 1A–3B. The angle of inclination could vary, depending upon the particular user and the design of the shaving head portion 104, 204, 305. Suitable angles of inclination may be, for example, from around 20° to around 70°, depending upon the user and also depending upon the angle at which the working shaving portion of the shaving head portion 404 is mounted on the handle portion of the shaver. The shaving head portion is preferably mounted to provide optimum results when the handle portion is inclined as shown in FIG. 4, so as to afford the user a good view, via the mirror, of the portions of the body which are to be shaved.

In use, the user presses the head portion 404 against the body part 420, and moves the inclined razor 400, such as in a direction indicated by the arrow labelled "S" in FIG. 4. In this manner, there is a lower region 422 of the body surface being shaved which has already been shaved, and there is an upper region 424 of the surface being shaved which is yet to be shaved.

The user observes the shaving procedure by directing their eye 430 towards the mirror 410 on the razor 400. In this manner, an image of an illustrative point "P" and upper region 424 on the surface of the body part 420 being shaved is reflected to the user's eye 430 and, in this case (i.e., with a concave mirror), is presented as a magnified image to the user, as indicated by the rays 432 and 434.

Whether the mirror is convex, concave, or flat, the user will be able to view the to-be-shaved region 424 of the surface during the process of shaving. As is evident from the explanatory diagram of FIG. 4, the reflected image viewed by the user in the mirror will be presented to the user at a substantially normal (i.e., 90°) angle. This is in marked contrast to the otherwise oblique direct view of the surface being shaved that the user would have to contend with, relying largely on sense of feel to guide their actions in the process of shaving.

FIG. 4 illustrates an additional advantage of the invention. A light 440 (labelled "L") is shown emitting light rays 442 and 444 which reflect off of the mirror 410 onto the surface being shaved. Such a light could, for example, be an overhead light in a bathroom. In this manner, the area being shaved is better illuminated, in a manner similar to that of the reflected image by normal rather than glancing rays, which will enhance the visibility of the surface being shaved. A specific light could also be directed to the mirror 410 instead of relying only on overhead or general bathroom illumination.

It should be understood that the illustration of FIG. 4 is highly schematic in nature, particularly with respect to the rays 432, 444, 442 and 444, and is not intended to establish or limit the invention to a precise usage or to a precise focal point or curvature of the concave mirror 410.

The present invention differs dramatically from the aforementioned prior art. None of the prior art patents discussed hereinabove disclose a mirror which is integral with a razor, more particularly, an integral component of the razor handle, operative in use (i.e., while shaving) to permit the user to view the surface being shaved during the operation of shaving, without requiring external instrumentalities such as a bathroom mirror. At best, certain of these prior art patents would suggest that there has been a long felt need, and commensurate failure of others, to provide an ergonomic device for permitting a user to observe an area being shaved, while shaving the area.

Although the invention has been illustrated and described in detail in the drawings and foregoing description, the same is to be considered as illustrative and not restrictive in character, it being understood that only preferred embodiments have been shown and described, and that all changes and modifications that come within the spirit of the invention are desired to be protected.

What is claimed is:

1. A shaving razor, comprising:

a handle portion, said handle portion having an end, and said handle portion consisting essentially of a wall having a front surface and a rear surface;

a head portion at the end of the handle portion, the head portion being always immovably and fixedly held in a same fixed position relative to the end of the handle portion, and the head portion carrying a razor blade extending and projecting forwardly of the front surface of the handle portion at an angle relative to the front surface of the handle portion and in a direction in which the front surface faces, so that the razor blade is always in an operable position ready for shaving; and a mirror integrally mounted to the front surface of the handle portion of the razor, said mirror being one of planar and concave, said mirror being exposed for direct viewing by an operator at all times during a shaving operation, regardless of whether said razor is in a storage condition, and said handle portion being free of any frontwardly projecting portions that extend forwardly of said mirror such that, during a shaving operation, said mirror is arranged to always provide a clear, direct and unobstructed view to the user of a to-be-shaved region of a body portion being shaved by the user during the shaving operation, without requiring other separate mirrors for viewing during the shaving operation.

2. A shaving razor according to claim 1, wherein the mirror is planar.

3. A shaving razor according to claim 1, wherein the mirror is curved.

4. A shaving razor according to claim 3, wherein the mirror is concave.

5. A shaving razor according to claim 1, wherein:

the mirror is recessed into the front surface of the handle portion.

6. A shaving razor according to claim 1, wherein the handle portion is textured.

7. A shaving razor according to claim 1, wherein the handle portion has an arcuate side profile.

8. A shaving razor according to claim 1, wherein the handle portion has a generally rectangular front profile.

9. A shaving razor according to claim 1, wherein the handle portion has a generally bottle-shaped front profile.

10. A shaving razor according to claim 1, wherein a top edge of the handle portion is generally rectilinear.

11. A shaving razor according to claim 10, wherein:

said razor blade is rectilinear.

12. A shaving razor according to claim 1, wherein a top edge of the handle portion is generally arcuate.

13. A shaving razor according to claim 12, wherein:

said razor blade is arcuate.

14. A shaving razor according to claim 1, wherein said wall has a substantially constant depth or thickness.

* * * * *